US009601878B2

(12) United States Patent
Sunaga et al.

(10) Patent No.: US 9,601,878 B2
(45) Date of Patent: Mar. 21, 2017

(54) COMMUNICATION MODULE AND COMMUNICATION MODULE CONNECTOR

(71) Applicant: Hitachi Metals, Ltd., Minato-ku, Tokyo (JP)

(72) Inventors: Yoshinori Sunaga, Hitachinaka (JP); Izumi Fukasaku, Hitachi (JP); Kinya Yamazaki, Hitachi (JP)

(73) Assignee: Hitachi Metals, Ltd., Tokyo (JP)

( * ) Notice: Subject to any disclaimer, the term of this patent is extended or adjusted under 35 U.S.C. 154(b) by 0 days.

(21) Appl. No.: 14/991,059

(22) Filed: Jan. 8, 2016

(65) Prior Publication Data

US 2016/0365679 A1 Dec. 15, 2016

(30) Foreign Application Priority Data

Jun. 9, 2015 (JP) ..... 2015-116238
Sep. 29, 2015 (JP) ..... 2015-190536

(51) Int. Cl.
*H01R 13/66* (2006.01)

(52) U.S. Cl.
CPC ..... *H01R 13/665* (2013.01)

(58) Field of Classification Search
USPC ..... 439/620.21, 65, 108, 62, 79, 660, 495
See application file for complete search history.

(56) References Cited

U.S. PATENT DOCUMENTS 5,954,521 A * 9/1999 Yang ..... G06F 13/409 439/59
6,227,867 B1 * 5/2001 Chen ..... H01R 12/57 29/842
7,101,188 B1 * 9/2006 Summers ..... H01R 12/725 439/59
7,232,345 B2 * 6/2007 Ishizuka ..... H01R 13/6585 439/660
7,625,231 B2 * 12/2009 Takahira ..... H01R 12/79 439/260
8,177,564 B1 * 5/2012 Ito ..... H01R 13/6471 439/108
8,545,234 B2 * 10/2013 Szczesny ..... G02B 6/428 439/62
9,166,315 B1 * 10/2015 Phillips ..... H01R 12/725
9,409,331 B2 * 8/2016 Liu ..... H01R 12/725
2003/0064625 A1 * 4/2003 Ozai ..... H01R 9/032 439/579

(Continued)

FOREIGN PATENT DOCUMENTS

JP 2013-84577 A 5/2013

*Primary Examiner* — Alexander Gilman
(74) *Attorney, Agent, or Firm* — Crowell & Moring LLP

(57) ABSTRACT

A communication module is further miniaturized to achieve an improvement in the mounting density of the communication module. A communication module includes a plug connector connected to a receptacle connector, and the plug connector has an insertion projection inserted into an insertion recess provided on the receptacle connector. The insertion projection has a board insertion portion into which an insertion end portion of a module board incorporated in the communication module is inserted formed therein, the insertion end portion is inserted into the board insertion portion, and first electrodes formed on the plug connector are electrically connected to the module board.

10 Claims, 8 Drawing Sheets

(56) References Cited

U.S. PATENT DOCUMENTS

| | | | | |
|---|---|---|---|---|
| 2003/0171012 | A1* | 9/2003 | Korsunsky | H05K 1/117<br>439/79 |
| 2013/0089991 | A1* | 4/2013 | Ito | H01R 12/721<br>439/65 |

* cited by examiner

COMMUNICATION MODULE AND COMMUNICATION MODULE CONNECTOR

CROSS-REFERENCE TO RELATED APPLICATION

The present application claims priority from Japanese Patent Applications No. 2015-116238 filed on Jun. 9, 2015 and No. 2015-190536 filed on Sep. 29, 2015, the contents of which are hereby incorporated by reference into this application.

TECHNICAL FIELD OF THE INVENTION

The present invention relates to a communication module and to a communication module connector.

BACKGROUND OF THE INVENTION

A board incorporated in so-called IT (Information Technology) devices such as servers and network equipment is generally referred to as "motherboard," and a plurality of communication modules are connected to such a motherboard.

Here, to achieve higher performance and further reduced power consumption of an IT device and the like, it is necessary to further miniaturize each communication module and mount as many communication modules as possible on a housing panel (front panel or rear panel) of the IT device and the like. More specifically, it is necessary to reduce the width of each communication module so that a plurality of communication modules are mounted on a housing panel of a given size at high density.

One method of reducing the width of the communication module is to reduce the pitch of electrodes formed on a connector connecting the motherboard to the communication module. This connector has been conventionally known as a two-piece structure connector composed of a male connector (plug connector) and a female connector (receptacle connector) and having electrodes arranged at a narrow pitch.

When the two-piece structure connector is used to connect the communication module to the motherboard, the communication module is provided with the plug connector while the motherboard is provided with the receptacle connector in many cases. Also, the communication module may be provided with a card edge type connector. This is because the card edge type connector is suitable for providing a plurality of electrodes having stable quality at low cost. The card edge type connector, however, has low accuracy and is therefore unsuitable for reducing the pitch of electrodes (see, e.g., Japanese Patent Application Laid-Open Publication. No. 2013-84577 (Patent Document 1)).

SUMMARY OF THE INVENTION

When a communication module is provided with a plug connector, a board incorporated in the communication module and the plug connector must be fixed together firmly with a high degree of accuracy. Thus, in a conventional case shown in FIGS. 7 and 8, a plug connector 80 is provided with a board holding portion 81. Note that, in the following description, to distinguish a board incorporated in an IT device and the like from a board incorporated in a communication module to be connected to the former board, the former board may be referred to as "motherboard" and the latter board as "module board."

As shown in FIGS. 7 and 8B, the board holding portion 81 has an outline that is generally U-shaped in a plan view and encircles an end of a module board 82 to hold that end. However, when the plug connector 80 is provided with the board holding portion 81, the width (W) of the plug connector 80 increases as a whole. Specifically, the left and right parts of the board holding portion 81 create an additional width of about 1 to 2 mm in total to the width (W) of the plug connector 80. In other words, the board holding portion 81 overhangs outward from both sides of the module board 82. As a result, the total width of the communication module provided with the plug connector 80 inevitably increases, which is a hindrance to miniaturization and high-density mounting of the communication module.

The object of the present invention is to further miniaturize a communication module to achieve an improvement in the mounting density of the communication module.

A communication module according to the present invention includes a plug connector connected to a receptacle connector. The plug connector has an insertion projection inserted into an insertion recess provided on the receptacle connector. A board insertion portion into which an insertion end portion of a module board incorporated in the communication module is inserted is formed in the insertion projection, the insertion end portion is inserted into the board insertion portion, and a first electrode formed on the plug connector is electrically connected to the module board.

A communication module connector according to the present invention includes a plug connector and a receptacle connector to which the plug connector is connected. The plug connector has an insertion projection, and the receptacle connector has an insertion recess into which the insertion projection is inserted. A board insertion portion into which an insertion end portion of a module board incorporated in a communication module including the plug connector is inserted is formed in the insertion projection, the insertion end portion is inserted into the board insertion portion, and a first electrode formed on the plug connector is electrically connected to the module board.

According to the present invention, a communication module is further miniaturized, and therefore an improvement in the mounting density of the communication module is achieved.

BRIEF DESCRIPTIONS OF THE DRAWINGS

DESCRIPTIONS OF THE PREFERRED EMBODIMENTS

An embodiment of the present invention will hereinafter be described in detail. A communication module according to this embodiment is connected to a motherboard incorporated in an IT device and the like via a communication module connector. The communication module connector that connects the communication module of this embodiment to the motherboard is a two-piece structure connector composed of a male connector incorporated in the communication module and a female connector incorporated in the motherboard. In the following description, the male connector incorporated in the communication module is referred to as "plug connector" while the female connector incorporated in the motherboard is referred to as "receptacle connector," and both connectors may be collectively referred to as "connector." Specifically, the communication module of this embodiment includes the plug connector that can be inserted into and extracted from the receptacle connector incorporated in the motherboard, and the communication module and the motherboard are connected to each other via these plug connector and receptacle connector.

The motherboard, to which the communication module is connected in the above manner, carries a communication semiconductor chip mounted thereon, and the communication module connected to the motherboard is thus connected to the communication semiconductor chip via electric wiring formed on the motherboard. Moreover, the motherboard carries a plurality of receptacle connectors arranged thereon, and a plurality of communication modules are connected to the communication semiconductor chip via respective receptacle connectors.

Figure 1A:
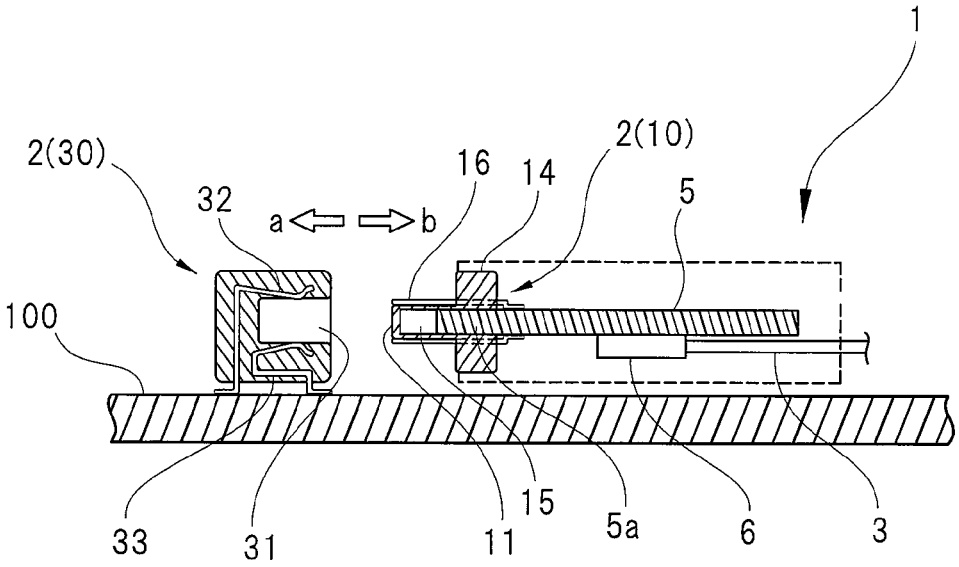
FIG. 1A is a sectional view of an example of a communication module and a communication module connector.

As shown in FIG. 1, a plug connector 10 incorporated in a communication module 1 of this embodiment has an insertion projection 11. A receptacle connector 30 incorporated in a motherboard 100, on the other hand, has an insertion recess 31. The insertion projection 11 of the plug connector 10 is inserted into the insertion recess 31 of the receptacle connector 30 along the direction of an arrow a (insertion direction) shown in FIG. 1A and is extracted from the insertion recess 31 of the receptacle connector 30 along the direction of an arrow b (extraction direction). When the insertion projection 11 of the plug connector 10 is inserted into the insertion recess 31 of the receptacle connector 30, electrodes provided on the plug connector 10 and receptacle connector 30, respectively, come in contact with each other. As a result, the communication module 1 and the motherboard 100 are electrically connected to each other via a connector 2, and this allows signal transmission/reception (input/output) between the communication module 1 and the communication semiconductor chip mounted on the motherboard 100.

Figure 2:
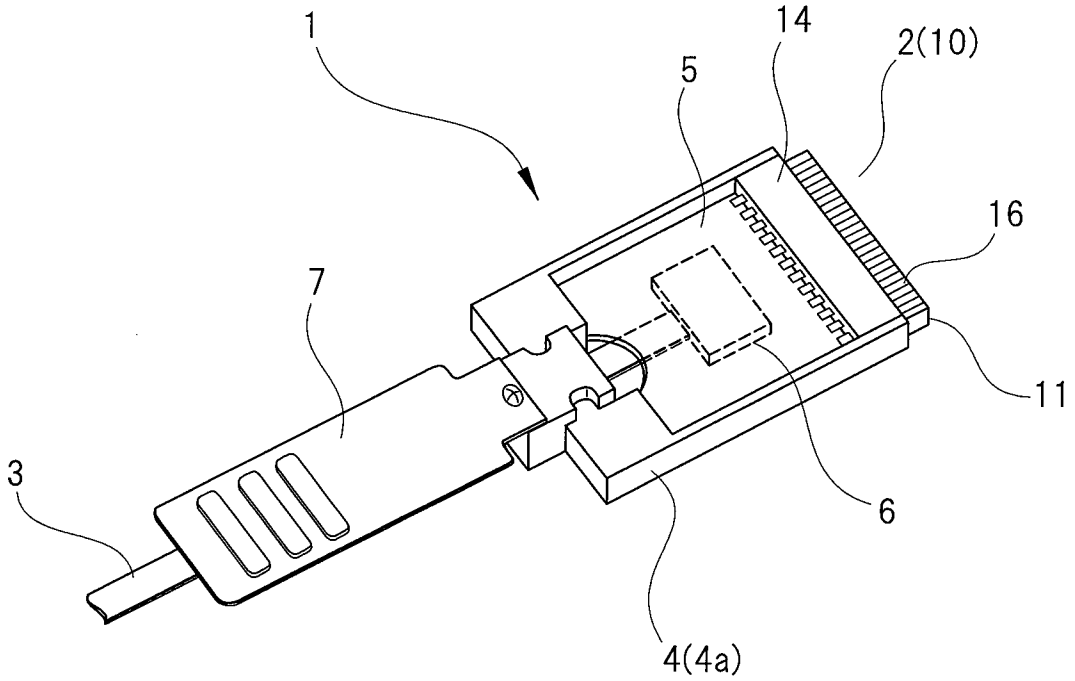
FIG. 2 is a perspective view of an example of the internal structure of the communication module.

As shown in FIG. 2, the communication module 1 includes a housing 4 into which one end of an optical fiber (fiber ribbon) 3 is led and a module board 5 housed in the housing 4, and the module board 5 has a photoelectric conversion unit 6 provided thereon. Note that the housing is composed of a lower case 4*a* shown in FIG. 2 and an upper case not shown in FIG. 2. The lower case 4*a* and the upper case are abutted against each other to make up the housing 4 having a space in which the module board 5 can be placed.

Moreover, though not depicted in FIG. 2, the photoelectric conversion unit 6 includes at least a light-emitting element, a driving IC (Integrated Circuit) that drives the light-emitting element, a light-receiving element, and an amplifying IC that amplifies a signal output from the light-receiving element. The module board 5 is provided with a lens block that optically connects the light-emitting element, the light-receiving element, and the optical fiber 3. One end of the optical fiber 3 led into the housing 4 is (optically) connected to the lens block via an MT (Mechanically Transferable) connector. Specifically, the front end surface of the MT connector is abutted against the abutting surface of the lens block. Moreover, a pair of guide pins is projected from the abutting surface of the lens block, and these guide pins are inserted into guide holes formed on the front end surface of the MT connector. Note that, in this embodiment, the light-emitting element is provided as a VCSEL (Vertical Cavity Surface Emitting Laser) and the light-receiving element is provided as a PD (Photodiode). These light-emitting element and light-receiving element are, however, not limited to specific light-emitting elements and light-receiving elements. Also, the rear end of the housing 4 is attached with a pull-tab 7, which is held to extract the plug connector 10 from the receptacle connector 30 (FIG. 1).

Figure 1B:
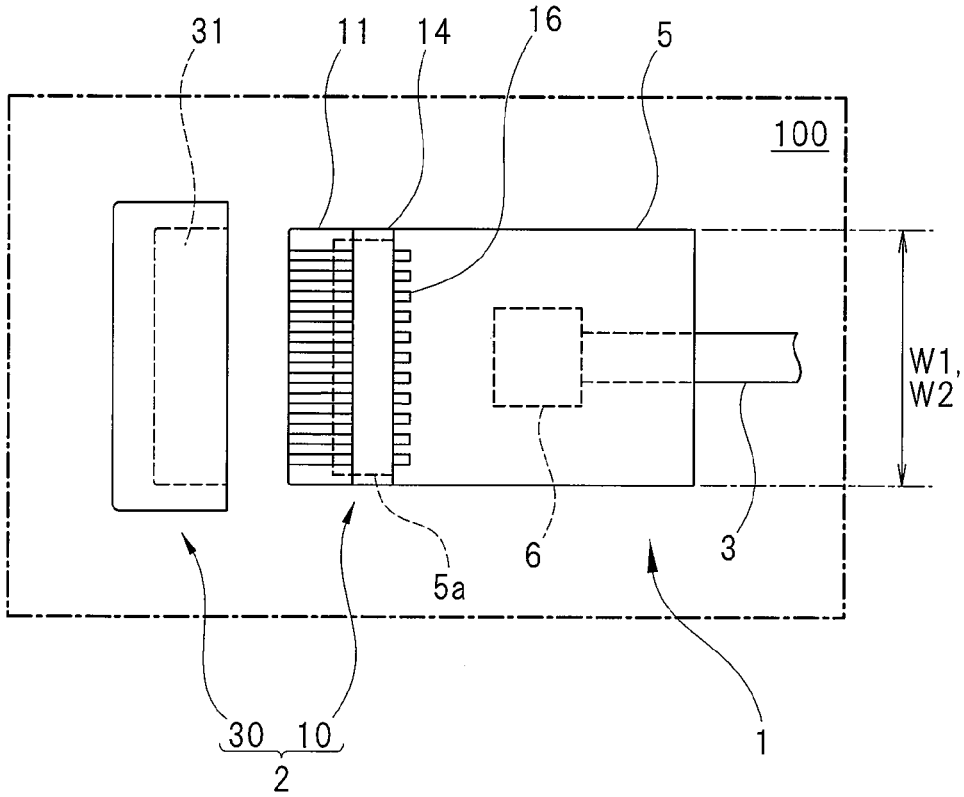
FIG. 1B is a plan view of the communication module and the communication module connector.

Referring to FIG. 1 again, the insertion projection 11 of the plug connector 10 is tabular, and a flange 14 is formed integrally behind the insertion projection 11. In other words, the insertion projection 11 projects from the front surface of the flange 14. As shown in FIG. 1B, the width (W1) of the insertion projection 11 and of the flange 14 is the same as the maximum width (W2) of the module board 5. In other words, the width (W1) of the plug connector 10 is the same as the maximum width (W2) of the module board 5. The plug connector 10, therefore, does not overhang outward from both sides of the module board 5, and both side surfaces of the plug connector 10 are completely or almost flush with both side surfaces of the module board 5.

Figure 3:
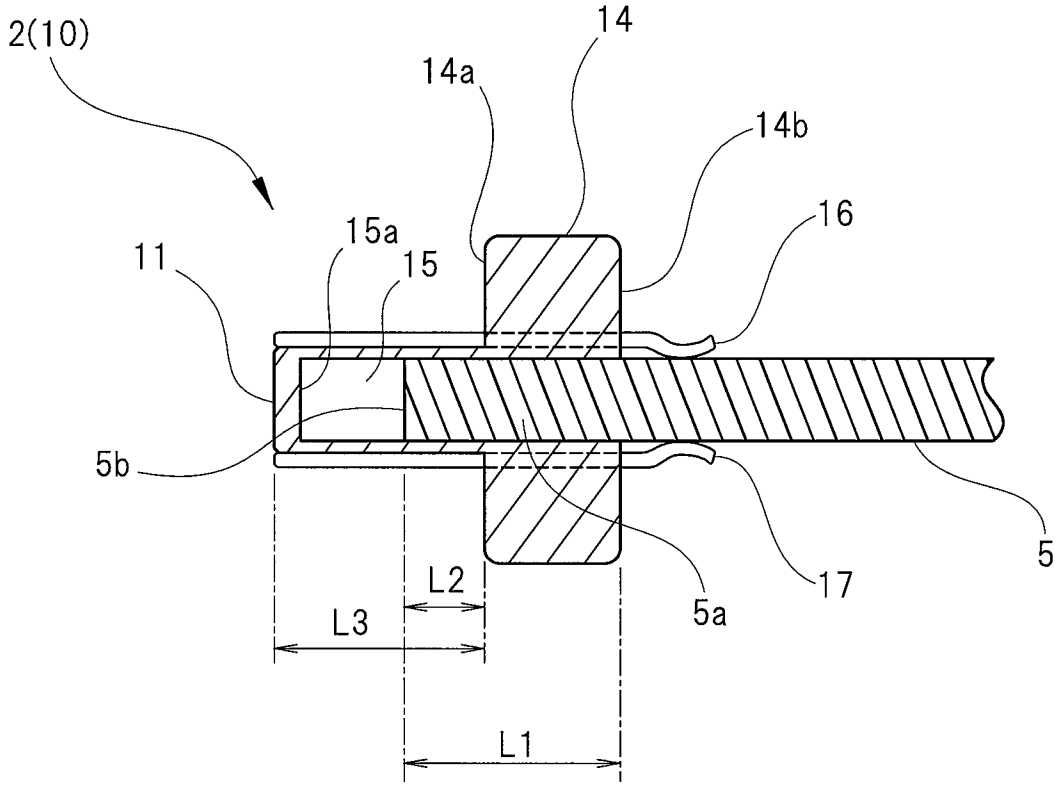
FIG. 3 is an enlarged sectional view (side sectional view) of an example of the connection structure of a plug connector and a module board.

As shown in FIG. 3, a part of the module board 5 is inserted into the inside of the plug connector 10. Specifically, a board insertion portion 15 which is open to the outside at the rear surface 14*b* of the flange 14 is formed inside the plug connector 10. This board insertion portion 15 has the same shape as the shape of an end of the module board 5, and the end of the module board 5 is inserted into the board insertion portion 15. More specifically, as shown in FIG. 1B, an insertion end portion 5*a* slightly smaller in width than the other part of the module board 5 is formed at one end in the longitudinal direction of the module board 5, and this insertion end portion 5*a* is inserted into the board insertion portion 15 (FIG. 3). In other words, the part of the end of the module board 5 that is inserted into the board insertion portion 15 (FIG. 3) is the insertion end portion 5*a*. Also, the maximum width (W2) of the module board 5 shown in FIG. 1B represents the width of the part of the module board 5 other than the insertion end portion 5*a*. As shown in FIG. 3, the front end surface 5*b* of the module board 5 (insertion end portion 5*a*), however, is not in contact with the bottom surface 15*a* of the board insertion portion 15.

Specifically, a part of the full length (L1) of the insertion end portion 5*a* is inserted into the insertion projection 11 so as to reach the inside of the insertion projection 11 beyond the flange 14. According to this embodiment, the insertion length (L2) of the insertion end portion 5*a* to the insertion projection 11 is about ½ of the full length (L3) of the insertion projection 11.

Here, the plug connector 10 is manufactured by injection molding, so chat the board insertion portion 15 has high dimensional accuracy. The module board 5 (insertion end portion 5*a*) inserted into the board insertion portion 15, therefore, is fixed firmly and with a high degree of accuracy to the plug connector 10.

As shown in FIG. 1, a plurality of first electrodes are provided on the outer surface of the insertion projection 11. Specifically, as shown in FIG. 3, a plurality of upper first electrodes 16 are provided on the upper surface of the insertion projection 11 while a plurality of lower first electrodes 17 are provided on the lower surface of the insertion projection 11. As shown in FIG. 1B, the upper first electrodes 16 are arranged at a given pitch (0.5 mm pitch according to this embodiment) along the width direction of the insertion projection 11. Though not depicted in FIG. 1B, the lower first electrodes 17 (FIG. 3) are also arranged at the same pitch as the upper first electrodes 16 along the width direction of the insertion projection 11.

As shown in FIG. 3, each of the upper first electrodes 16 and lower first electrodes 17 is strip-shaped and passes through the flange 14 to extend in the insertion/extraction direction of the plug connector 10. One end (front end) of each of the upper first electrodes 16 and lower first electrodes 17 projects from the front surface 14*a* of the flange 14 and reaches substantially the same position as the front end of the insertion projection 11, and the other end (rear end) of each of the upper first electrodes 16 and lower first electrodes 17 projects from the rear surface 14*b* of the flange 14. The rear end of the upper first electrode 16 and the rear end of the lower first electrode 17 are opposed to each other, and the insertion end portion 5*a* of the module hoard 5 is inserted into the board insertion portion 15 through a space between the rear end of the upper first electrode 16 and the rear end of the lower first electrode 17. In other words, the upper first electrode 16 and the lower first electrode 17 are opposed to each other across the module board 5. The rear end of the upper first electrode 16 is soldered to an electrode pad (not depicted) formed on the surface of the module board 5, while the rear end of the lower first electrode 17 is soldered to an electrode pad (not depicted) formed on the back surface of the module board 5. Note that each upper first electrode 16 is positioned by being partially fitted in a groove formed on the upper surface of the insertion projection 11, while each lower first electrode 17 is positioned by being partially fitted in a groove formed on the lower surface of the insertion projection 11.

Figure 4:
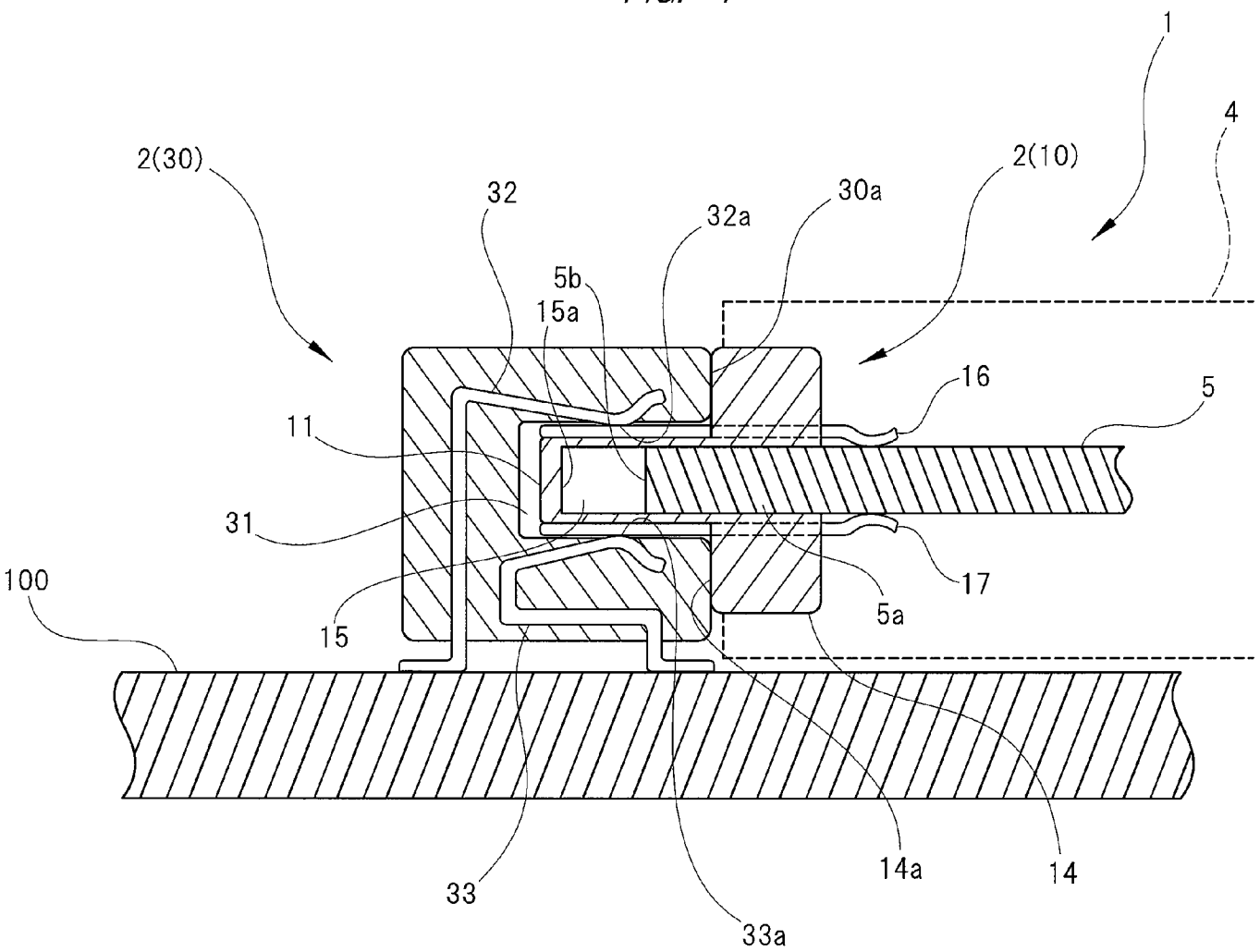
FIG. 4 is an enlarged sectional view (side sectional view) of the connection state of the plug connector and a receptacle connector.

As shown in FIG. 1A, the receptacle connector 30 has a plurality of second electrodes built therein. Specifically, as shown in FIG. 4, the receptacle connector 30 has pairs of upper second electrodes 32 and lower second electrodes 33 built therein such that a part (contact 32*a*) of each upper second electrode 32 is exposed on an inner surface (upper surface) of the insertion recess 31 while a part (contact 33*a*) of each lower second electrode 33 is exposed on another inner surface (lower surface) of the insertion recess 31.

When the insertion projection 11 of the plug connector 10 is inserted into the insertion recess 31 of the receptacle connector 30, the front end of each upper first electrode 16 provided on the plug connector 10 comes in contact with the contact 32*a* of each upper second electrode 32 built in the receptacle connector 30, thus being electrically conducted. At the same time, the front end of each lower first electrode 17 provided on the plug connector 10 comes in contact with the contact 33*a* of each lower second electrode 33 built in the receptacle connector 30, thus being electrically conducted. Note that the upper second electrode 32 and lower second electrode 33 built in the receptacle connector 30 are bent in such a manner as shown in FIG. 4 and have elasticity. Therefore, the upper second electrode 32 of the receptacle connector 30 is kept in pressure contact with the upper first electrode 16 of the plug connector 10 by its elastic restoring force. Similarly, the lower second electrode 33 of the receptacle connector 30 is kept in pressure contact with the lower first electrode 17 of the plug connector 10 by its elastic restoring force.

When the insertion projection 11 of the plug connector 10 is inserted into the insertion recess 31 of the receptacle connector 30, at least a part of the insertion end portion 5*a* of the module board 5 is inserted into the insertion recess 31 of the receptacle connector 30. As shown in FIG. 4, the insertion projection 11 is inserted into the insertion recess 31 until the front surface 14*a* of the flange 14 abuts against the front surface 30*a* of the receptacle connector 30. That is, the insertion length (fitting length) of the insertion projection 11 to the insertion recess 31 is equal to the full length (L3) of the insertion projection 11 shown in FIG. 3. Meanwhile, as described above, the insertion length (L2) of the module board 5 to the insertion projection 11 is about ½ of the full length (L3) of the insertion projection 11. As shown in FIG. 4, therefore, when the insertion projection 11 is inserted into the insertion recess 31, the part of the insertion end portion 5*a* that is equivalent to about ½ of the full length (L3) of the insertion projection 11 is inserted into the insertion recess 31.

As described above, when the plug connector 10 is connected to the receptacle connector 30, the plug connector 10 and the part of the module board 5 that is inserted into the plug connector 10 are both inserted and held in the insertion recess 31 of the receptacle connector 30.

Figure 7:
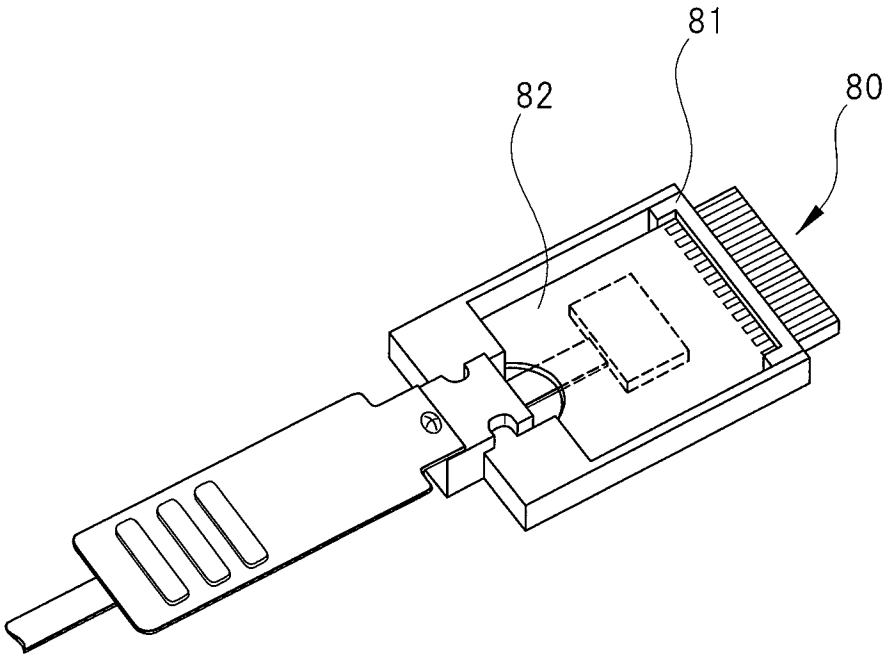
FIG. 7 is a perspective view of an example of the internal structure of a conventional communication module.
Figure 8A:
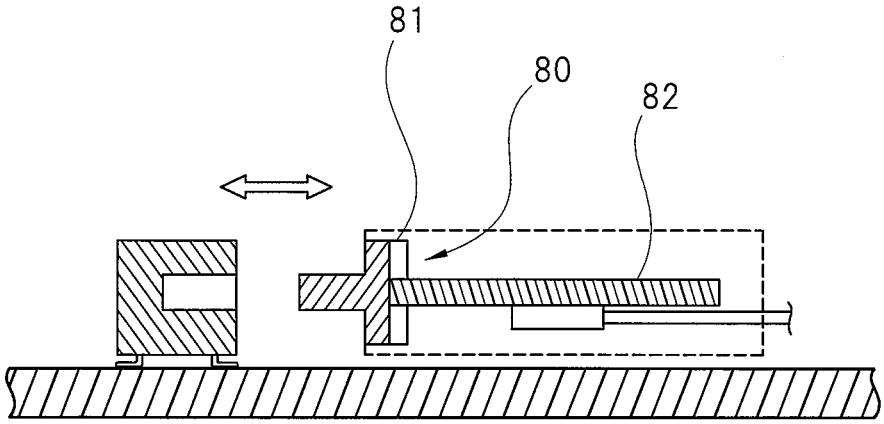
FIG. 8A is a sectional view of an example of a conventional communication module and a conventional communication module connector.
Figure 8B:
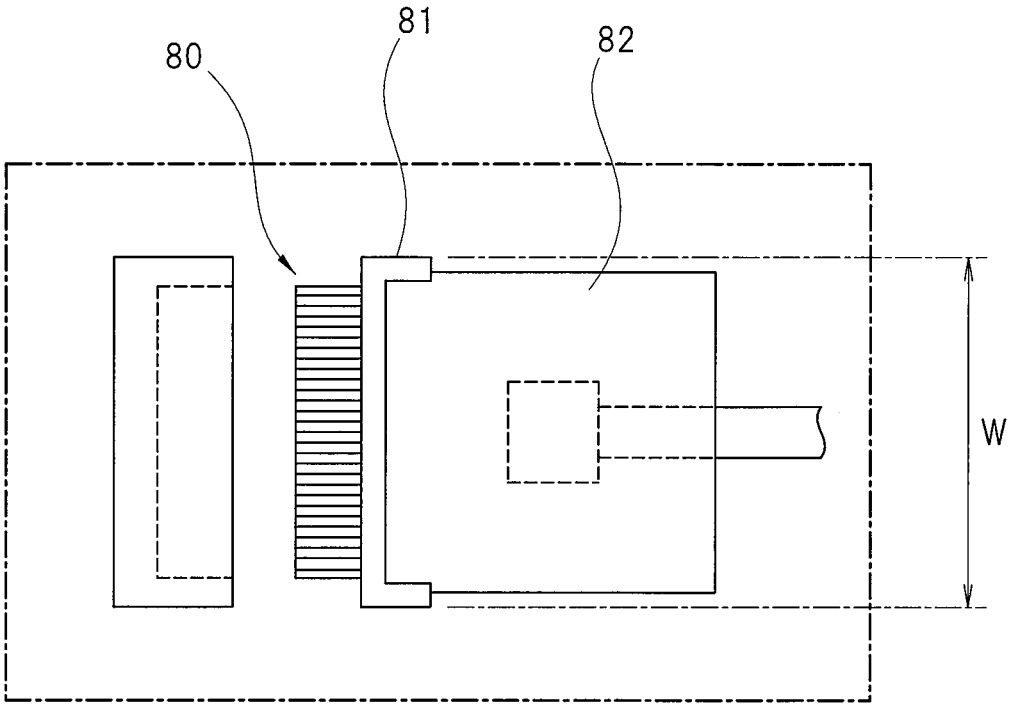
FIG. 8B is a plan view of the conventional communication module and the conventional communication module connector.

As described above, according to this embodiment, by inserting the part of the module board 5 into the board insertion portion 15 provided on the plug connector 10, the module board 5 and the plug connector 10 are fixed firmly with a high degree of accuracy without using the board holding portion 81 shown in FIGS. 7 and 8 or a member corresponding to the board holding portion 81. As a result, the width of the plug connector 10 is smaller than that in the conventional case, and the width of the communication module 1 including the plug connector 10 is also smaller than that in the conventional case. To put it another way, the communication module 1 is miniaturized, which allows mounting of the communication module 1 at higher density than before. Moreover, when the plug connector 10 is connected to the receptacle connector 30, the whole of the insertion projection 11 of the plug connector 10 and the part of the module board 5 are inserted simultaneously into the insertion recess 31 of the receptacle connector 30 and are held integrally in the insertion recess 31.

According to this embodiment, in the mounting structure in which the plug connector (male connector) 10 of the two-piece structure connector is mounted to the module board 5, the plug connector 10 is fixed to the module board 5 by inserting the part of the end of the module board 5 (insertion end portion 5*a*) into the board insertion portion 15 which is the recess of the plug connector 10. In other words, no adhesive and the like are provided between the insertion end portion 5*a* of the module board 5 and the board insertion portion 15 of the plug connector 10. This reduces man-hours for manufacturing. Note that, if such an adhesive and the like are used, the insertion end portion 5*a* of the module board 5 and the board insertion portion 15 of the plug connector 10 can be fixed more firmly together.

According to this embodiment, in the mounting structure in which the plug connector (male connector) 10 of the two-piece structure connector is mounted to the module board 5, the plug connector 10 is fixed to the module board 5 by inserting the front end surface 5*b* which is the part of the end of the module board 5 (insertion end portion 5*a*) into the board insertion portion 15 in such a manner that the front end surface 5*b* does not come in contact with the bottom surface 15*a* of the board insertion portion 15 which is the recess of the plug connector 10. In other words, the plug connector 10 can be fixed to the module board 5 even if the front end surface 5*b* which is the part of the end of the module board 5 (insertion end portion 5*a*) is not inserted deeply into the board insertion portion 15 of the plug connector 10. Therefore, for example, even if the insertion end portion 5*a* of the module board. 5 is short, the plug connector 10 can be fixed to the module board 5. In addition, this structure prevents damage to the insertion end portion 5*a* of the module board 5.

According to this embodiment, the receptacle connector 30 (female connector) of the two-piece structure connector has the pairs of the upper second electrodes 32 and lower second electrodes 33 built therein, and the straight line connecting the upper contact 32*a* to the lower contact 33*a* is designed so as to perpendicularly intersect the insertion/extraction direction (directions indicated by the arrows a and b) in a side sectional view (e.g., FIG. 4). As a result, the pairs of the contacts can hold the insertion projection 11 of the plug connector 10 effectively.

According to this embodiment, the receptacle connector 30 (female connector) of the two-piece structure connector has the pairs of the upper second electrodes 32 and lower second electrodes 33 built therein. In a side sectional view (e.g., FIG. 4) of these electrodes, each upper second electrode 32 is bent acutely on its end part to expose the contact 32*a*, which is a part of the upper second electrode 32, on the inner surface of the insertion recess 31, while each lower second electrode 33 is bent obtusely on its end part to expose the contact 33*a*, which is a part of the lower second electrode 33, on the inner surface of the insertion recess 31. This allows miniaturization of the receptacle connector 30. More specifically, in FIG. 1, the receptacle connector 30 can be reduced in size in the insertion/extraction direction (directions indicated by the arrows a and b).

In a first modification example of this embodiment, in a mounting structure in which the plug connector (male connector) 10 of the two-piece structure connector is mounted to the module board 5, the plug connector 10 is fixed to the module board 5 by interposing an adhesive and the like between the part of the end of the module board 5 (insertion end portion 5*a*) and the board insertion portion 15 which is the recess of the plug connector 10 and inserting the insertion end portion 5*a* of the module board 5 into the board insertion portion 15 of the plug connector 10. In other words, according to the first modification example, the plug connector 10 is not fixed to the module board 5 by merely inserting the insertion end portion 5*a* of the module board 5 into the board insertion portion 15 of the plug connector 10 (with no adhesive and the like provided). The first modification example offers an advantage that there is no need to manufacture the insertion end portion 5*a* of the module board 5 or/and the board insertion portion 15 of the plug connector 10 with a high degree of accuracy. Moreover, the first modification example offers another advantage that even if the board insertion portion 15 of the resin-molded plug connector deforms in the direction of widening due to its time-dependent change, the plug connector 10 can be kept fixed to the module board 5.

In a second modification example of this embodiment, in a mounting structure in which the plug connector (male connector) 10 of the two-piece structure connector is mounted to the module board 5, the plug connector 10 is fixed to the module board 5 by inserting the part of the end of the module board 5 (insertion end portion 5*a*) into the board insertion portion 15 which is the recess formed inside the insertion projection 11 of the plug connector 10 and fastening the insertion projection 11 of the plug connector 10 and the insertion end portion 5*a* of the module board 5 to each other with a fastening member such as a screw and the like. The second modification example offers an advantage that there is no need to manufacture the insertion end portion 5*a* of the module board 5 or/and the board insertion portion 15 of the plug connector 10 with a high degree of accuracy. Moreover, the second modification example offers another advantage that even if the board insertion portion 15 of the resin-molded plug connector deforms in the direction of widening due to its time-dependent change, the plug connector 10 can be kept fixed to the module board 5. Note that the technical concept of the first modification example may be added to the second modification example. Specifically, an adhesive and the like may be interposed between the insertion end portion 5*a* of the module board 5 and the board insertion portion 15 of the plug connector 10.

Figure 5:
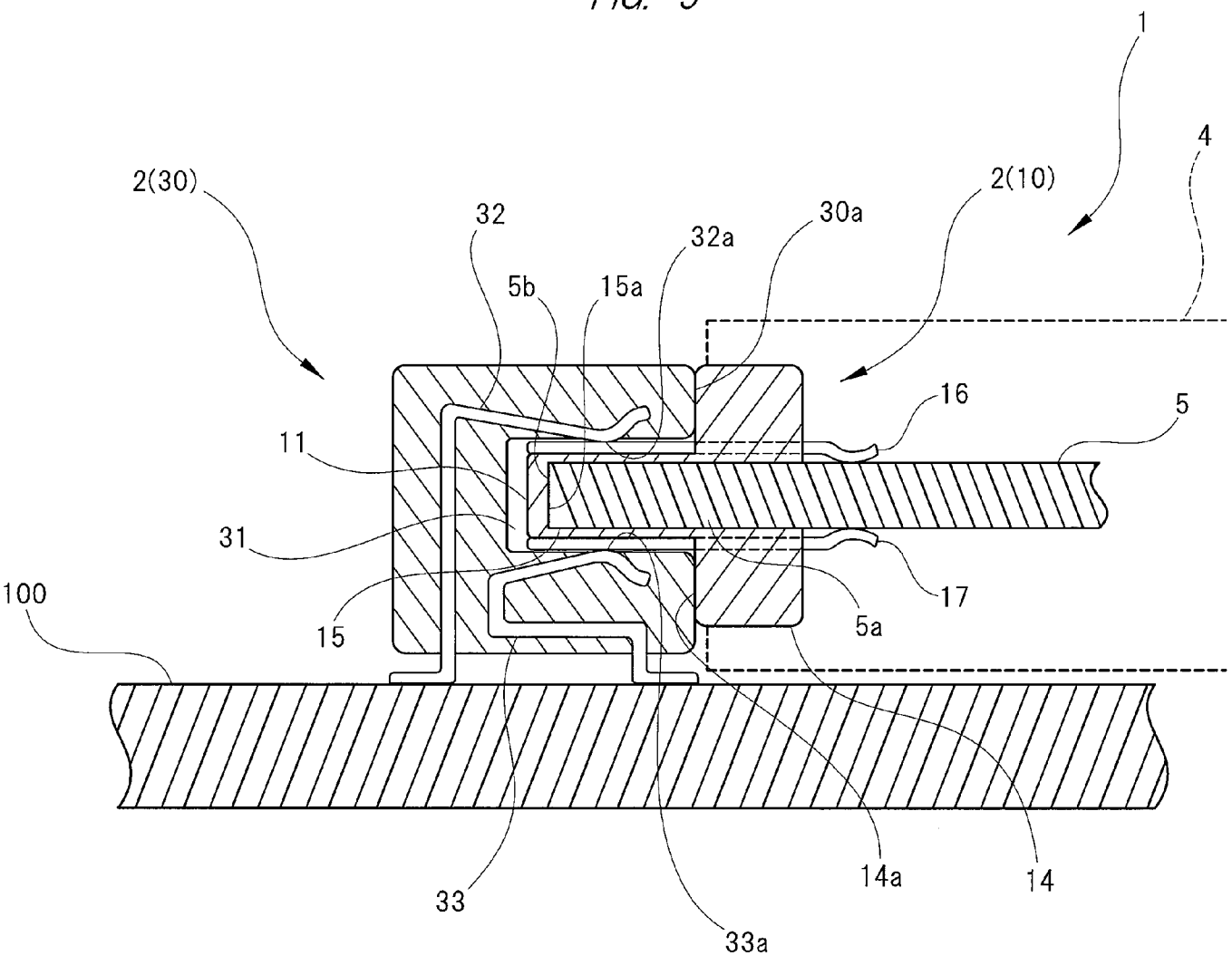
FIG. 5 is an enlarged sectional view (side sectional view) of another example of the connection structure of the plug connector and the module board.

The present invention is not limited to the above embodiment and may be modified into various forms of applications without departing from the scope of the invention. For example, the insertion length of the module board to the plug connector may be changed arbitrarily provided that the module board and the plug connector are fixed together as firmly as or more firmly than in the conventional case. Specifically, the insertion length (L2) shown in FIG. 3 may be changed arbitrarily. As an example, as shown in FIG. 5, the insertion end portion 5*a* of the module board 5 may be inserted deeply until the front end surface 5*b* of the insertion end portion 5*a* comes in contact with the bottom surface 15*a* of the board insertion portion 15. In this case, the insertion length (L2) of the insertion end portion 5*a* to the insertion projection 11 is substantially the same as the full length (L3) of the insertion projection 11. Moreover, in this case, the insertion end portion 5*a* is inserted deeper beyond the contact between the upper first electrode 16 and the upper second electrode 32 and the contact between the lower first electrode 17 and the lower second electrode 33. As a result, the module board 5 is interposed between the upper electrodes and the lower electrodes, in which case cross-talk is reduced. More specifically, a ground surface (ground layer) included in the module board 5, which is not depicted, is interposed between the upper electrodes and the lower electrodes, thereby reducing cross-talk between the upper electrodes and the lower electrodes.

Figure 6:
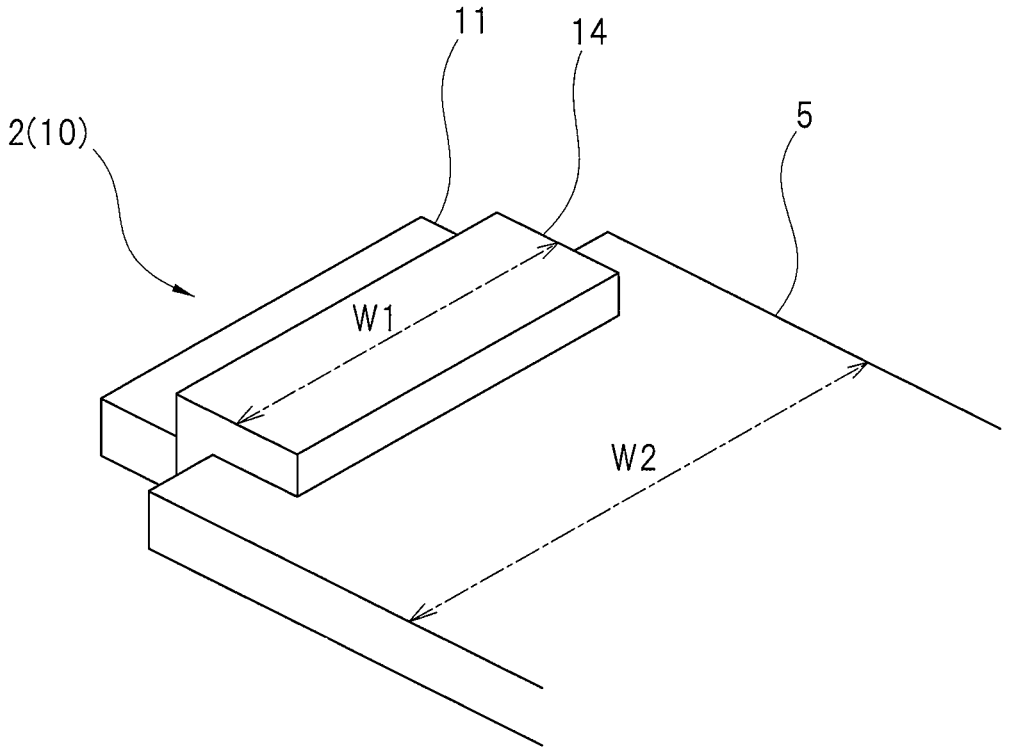
FIG. 6 is a perspective view of still another example of the connection structure of the plug connector and the module board.

The pitch of each electrode provided on the plug connector 10 and that of each electrode provided on the receptacle connector 30 are not limited to 0.5 mm, respectively. To achieve high-density mounting of the communication module 1, however, the pitch of each electrode should preferably be equal to or smaller than 0.7 mm. Moreover, the width of the plug connector may not be the same as the width of the module board and may be smaller than the width of the module board. For example, as shown in FIG. 6, the width (W1) of the plug connector 10 may be smaller than the width including the parts other than the part of the module board 5 which is inserted into the plug connector 10, that is, may be smaller than the maximum width (W2) of the module board 5.

Moreover, if the sufficient thickness of the flange 14 can be ensured, the depth of the board insertion portion 15 formed inside the plug connector 10 may be determined to be a depth of such an extent that does not allow the insertion end portion 5*a* to be inserted into the insertion recess 31 when the insertion projection 11 is inserted into the insertion recess 31.

The present invention is applied not only to a communication module and a communication module connector for optical communication, but also to a communication module and a communication module connector for electric communication. For example, the optical fiber 3 shown in FIG. 1 and the like may be replaced with a metal wire.

In another embodiment, the communication module may be provided with a nail, protrusion, and the like that are engaged with a locking portion provided on the receptacle connector or its vicinity. In this case, the pull-tab 7 shown in FIG. 2 may also serve as an operating unit that moves the nail or protrusion to disengage it from the locking portion.

What is claimed is:

1. A communication module comprising a plug connector connected to a receptacle connector, wherein the plug connector has an insertion projection inserted into an insertion recess provided on the receptacle connector, a board insertion portion into which an insertion end portion of a module board incorporated in the communication module is inserted is formed in the insertion projection, the insertion end portion is inserted into the board insertion portion, a first electrode formed on the plug connector is electrically connected to the module board, and wherein when the insertion projection is inserted into the insertion recess, at least a part of the insertion end portion inserted into the board insertion portion is also inserted into the insertion recess.

2. The communication module according to claim 1, wherein when the insertion projection is inserted into the insertion recess, a first electrode formed on the plug connector is electrically connected to a second electrode formed on the receptacle connector.

3. The communication module according to claim 2, wherein when the insertion projection is inserted into the insertion recess, the insertion end portion is inserted into the insertion recess deeper beyond a contact between the first electrode and the second electrode.

4. The communication module according to claim 1, wherein a width of the plug connector is equal to or smaller than a maximum width of the module board.

5. The communication module according to claim 1, wherein a pitch of the first electrodes is 0.7 mm or less.

6. A communication module connector comprising:

a plug connector; and a receptacle connector to which the plug connector is connected, wherein the plug connector has an insertion projection, the receptacle connector has an insertion recess into which the insertion projection is inserted, a board insertion portion into which an insertion end portion of a module board incorporated in a communication module including the plug connector is inserted is formed in the insertion projection, the insertion end portion is inserted into the board insertion portion, a first electrode formed on the plug connector is electrically connected to the module board, and wherein when the insertion projection is inserted into the insertion recess, at least a part of the insertion end portion inserted into the board insertion portion is also inserted into the insertion recess.

7. The communication module connector according to claim 6, wherein when the insertion projection is inserted into the insertion recess, a first electrode formed on the plug connector is electrically connected to a second electrode formed on the receptacle connector.

8. The communication module connector according to claim 7, wherein when the insertion projection is inserted into the insertion recess, the insertion end portion is inserted into the insertion recess deeper beyond a contact between the first electrode and the second electrode.

9. The communication module connector according to claim 6, wherein a width of the plug connector is equal to or smaller than a maximum width of the module board.

10. The communication module connector according to claim 6, wherein a pitch of the first electrodes is 0.7 mm or less.

* * * * *